US007906946B2

(12) United States Patent
Taguchi et al.

(10) Patent No.: US 7,906,946 B2
(45) Date of Patent: Mar. 15, 2011

(54) SEMICONDUCTOR INTEGRATED CIRCUIT DEVICE FOR PROVIDING SERIES REGULATOR

(75) Inventors: Shinichirou Taguchi, Nukata-gun (JP); Yasuyuki Ishikawa, Kariya (JP); Akira Suzuki, Okazaki (JP); Hideaki Ishihara, Okazaki (JP)

(73) Assignee: Denso Corporation, Kariya (JP)

( * ) Notice: Subject to any disclaimer, the term of this patent is extended or adjusted under 35 U.S.C. 154(b) by 400 days.

(21) Appl. No.: 12/076,451

(22) Filed: Mar. 19, 2008

(65) Prior Publication Data

US 2008/0303497 A1 Dec. 11, 2008

(30) Foreign Application Priority Data

Mar. 29, 2007 (JP) ..... 2007-087754
Dec. 21, 2007 (JP) ..... 2007-330223

(51) Int. Cl.
*G05F 1/00* (2006.01)

(52) U.S. Cl. ..... 323/269

(58) Field of Classification Search ..... 323/269, 323/272

See application file for complete search history.

(56) References Cited

FOREIGN PATENT DOCUMENTS

| | | |
|---|---|---|
| JP | A-2001-66340 | 3/2001 |
| JP | A-2004-109056 | 4/2004 |
| JP | A-2007-19329 | 1/2007 |

OTHER PUBLICATIONS

Linear Technology, Datasheet for LTC1704, 2001,Linear Technology, pp. 1-28.*
Fairchild Semiconductor, Datasheet for FAN5063, Dec. 4, 2000, Rev. 1.0, pp. 1-14.*
National Semiconductor, Datasheet for LP2967, Jun. 2005,National Semiconductor, pp. 1-18.*

* cited by examiner

*Primary Examiner* — Adolf Berhane
*Assistant Examiner* — Jue Zhang
(74) *Attorney, Agent, or Firm* — Posz Law Group, PLC

(57) ABSTRACT

A semiconductor integrated circuit device for controlling an external output transistor is provided. The semiconductor integrated circuit device comprises: a first power supply circuit including an output circuit and providing a first series regulator in cooperation with the output external transistor; and a plurality of terminals. The plurality of terminals includes a control signal output terminal and high and low electric potential side power supply terminals for supplying electric power to the first power supply circuit. At least one of the high and low electric potential side power supply terminals is arranged adjacent to the control signal output terminal and defined as a first terminal. Short-circuiting between the control signal output terminal and the first terminal causes the external output transistor to switch into an off state.

12 Claims, 9 Drawing Sheets

SEMICONDUCTOR INTEGRATED CIRCUIT DEVICE FOR PROVIDING SERIES REGULATOR

CROSS REFERENCE TO RELATED APPLICATIONS

The present application is based on Japanese Patent Applications No. 2007-87754 filed on Mar. 29, 2007 and No. 2007-330223 filed on Dec. 21, 2007, the disclosure of which are incorporated herein by reference.

FIELD OF THE INVENTION

The present invention relates to a semiconductor integrated circuit device for providing a series regulator.

BACKGROUND OF THE INVENTION

Recently, a semiconductor integrated circuit device has progressively downsized by adopting a surface mount type package or narrowing a pitch between terminals. Because of narrowing the pitch between terminals, adjacent terminals are easy to short-circuit owing to, for example, a presence of a dust particle having a conductive property or a solder bridge produced in packaging the terminals on a substrate. In order to prevent or find short-circuiting between adjacent terminals, additional appearance inspection may be effective after terminal packaging process is performed. Detailed visual inspection in the appearance inspection process however leads to an increase in manufacturing cost.

Patent Document 1 shows a monitor circuit for checking an electric path resulting from short-circuiting. When the monitor circuit is mounted on a substrate, the monitor circuit can check a presence of the electric path connecting adjacent terminals. The monitor circuit includes a short detection circuit for detecting the presence of the path and a state display circuit for displaying a detection result from the short detection circuit. A semiconductor apparatus disclosed in Patent Document 2 includes a short detection line for detecting an occurrence of short-circuiting. The short detection line is arranged between at least one pair of adjacent terminals. A presence of short-circuiting between terminals is checked based on variation of an electric potential of the short detection line. As disclosed in Patent Document 2, an un-connection terminal is arranged between terminals to separates the terminals.

Patent Document 1—Japanese Patent Application Publication No. 2001-66340

Patent Document 2—Japanese Patent Application Publication No. 2007-19329

FIG. 9 is a schematic circuit diagram illustrating a configuration of a series regulator with using a conventional IC (integrated circuit) 1 and arrangement of terminals of the conventional IC. The IC 1 includes a power supply circuit 3 that provides a first series regulator in cooperation with a transistor 2 mounted on a substrate. The transistor 2 functions as an output transistor. The IC 1 further includes a power supply circuit 4 that has an output transistor, and that provides a second series regulator. One circuit between the power supply circuit 3 and the power supply circuit 4 is selected to operate on the basis of a selection signal SEL, which is provided from an outside of the IC 1 via a selection circuit in the IC 1.

The IC 1 includes high potential side power supply terminals 6, 7, a low potential side power supply terminal 8, a control signal output terminal 9, a phase compensation input terminal 10, a voltage output terminal 11, and a selection signal input terminal 12. The high potential side power supply terminals 6, 7 and the low potential side power supply terminal 8 are used for supplying electric power to the power supply circuits 3, 4. The electric power energizes the power supply circuits 3, 4 to operate. The control signal output terminal 9 is used for outputting a control signal REF to a base of the transistor 2 from the power supply circuit 3. The phase compensation input terminal 10 is used for inputting a phase compensation signal from an emitter of the transistor 2 to the power supply circuit 3. The voltage output terminal 11 is used for outputting a power supply voltage Vo from the power supply circuit 4 to a power output terminal 15 via a switch 14. The selection signal input terminal 12 is used for inputting the selection signal SEL thereto. The IC has a QFP (Quad flat package) configuration for instance. As shown in FIG. 9, the terminals 6-12 are arranged in the following order: the low potential side power supply terminal 8, the phase compensation input terminal 10, the control signal output terminal 9, the high potential side power supply terminals 6, 7, the voltage output terminal 11, and the selection signal input terminal 12.

In the IC 1, during the power supply circuit 3 is selected to operate on the basis of the selection signal SEL, when the high potential side power supply terminal and the control signal output terminal 9 adjacent to each other are short-circuited, the transistor 2 is configured to forcibly switch on. As a result, an excess electric current flows to a load (not shown) through the transistor 2 and the power output terminal 15. When the low potential side power supply terminal 8 and the phase compensation input terminal 10 adjacent to each other are short-circuited, an output circuit in the power supply circuit 3 increases the control signal REF. As a result, an excess current flows to the load.

During the power supply circuit 3 is selected to operate on the basis of the selection signal SEL and the switch 14 is in an on state, when the high potential side power supply terminal 7 and its adjacent voltage output terminal 11 are short-circuited, an output voltage Vcl increases to Vcc. As a result, a voltage larger than a predetermined power supply voltage (e.g., 5V) is output to the load coupled with the power output terminal 15.

SUMMARY OF THE INVENTION

In view of the above-described problem, it is an object of the present invention to provide a semiconductor integrated circuit device and an electric apparatus for providing a series regulator.

According to a first aspect of the present invention, a semiconductor integrated circuit device for controlling an external output transistor to be coupled with an external unit is provided. The semiconductor integrated circuit device comprises: a first power supply circuit that includes an output circuit, and that provides a first series regulator in cooperation with the output external transistor; and a plurality of terminals. The plurality of terminals includes: a control signal output terminal for outputting a control signal from an output node of the output circuit to a control terminal of the external output transistor; and a high electric potential side power supply terminal and a low electric potential side power supply terminal for supplying electric power to the first power supply circuit, the electric power being used as operating power of the first power supply circuit. At least one of the high and low electric potential side power supply terminals is arranged adjacent to the control signal output terminal and defined as a first terminal. An electric potential of the first terminal causes the external output transistor to switch into an off state when the control signal output terminal and the first terminal short-circuit.

According to the above semiconductor integrated circuit device, the semiconductor integrated circuit device includes the output circuit and further includes the first power supply circuit that provides the series regulator in cooperation with the external output transistor. The semiconductor integrated circuit device output the control signal from the output circuit to the control terminal of the external output transistor via the control signal output terminal. At least one of the high and low electric potential side power supply terminals is arranged adjacent to the control signal output terminal and defined as the first terminal. The electric potential of the first terminal provided when the first terminal and the control signal output terminal are short-circuited causes the external output transistor to switch off. When the first terminal and the control signal output terminal are short-circuited during the first power supply circuit is in an operating state, outputting an excess current from the first power supply circuit is configured to be prevented.

According to a second aspect of the present invention, a semiconductor integrated circuit device comprises: a second power supply circuit that includes an internal output transistor, and that provides a second series regulator; and a plurality of terminals. The plurality of terminals includes: a voltage output terminal for outputting a power supply voltage from the internal output transistor of the second power supply circuit; and a high electric potential side power supply terminal and a low electric potential side power supply terminal for supplying electric power to the second power supply circuit, the electric power being used as operating power of the second power supply circuit. At least one of the plurality of terminals, the one which is arranged adjacent to the voltage output terminal, provides a high impedance terminal or an input and output current limit terminal when the second power supply circuit is in an operating state.

According to the above semiconductor integrated circuit device, the above semiconductor integrated circuit device includes a second power supply circuit that includes an internal output transistor, and that provides a second series regulator. The second power supply circuit is configured to an output the power supply voltage to the voltage output terminal. At least one of the plurality of terminals, the one which is arranged adjacent to the voltage output terminal, is defined as a second terminal. When the second power supply circuit is in an operating state, the second terminal provides the high impedance terminal or the input and output current limit terminal. When the voltage output terminal and the second terminal are short-circuited during the second power supply circuit is in an operating state, outputting an excess current from the first power supply circuit is configured to be prevented.

According to a third aspect of the present invention, an electric apparatus comprises: an external output transistor to be coupled with an external unit; and a semiconductor integrated circuit device for controlling the external output transistor the semiconductor integrate circuit device including: a first power supply circuit that includes an output circuit, and that provides a first series regulator in cooperation with the external output transistor; a second power supply circuit that includes an internal output transistor, and that provides a second series regulator; and a plurality of terminals. The plurality of terminals includes: a control signal output terminal for outputting a control signal from an output node of the output circuit of the first power supply circuit to a control terminal of the external output transistor; a voltage output terminal for outputting a power supply voltage from the internal output transistor of the second power supply circuit; and a high electric potential side power supply terminal and a low electric potential side power supply terminal for supplying electric power to the first and second power supply circuits, the electric power being used as operating power of the first and second power supply circuits. At least one of the high and low electric potential side power supply terminals is arranged adjacent to the control signal output terminal and defined as a first terminal. The first terminal causes the external output transistor to be in an off state when the control signal output terminal and the first terminal short-circuit. At least one of the plurality of terminals, the one which is arranged adjacent to the voltage output terminal, provides a high impedance terminal or an input and output current limit terminal when the second power supply circuit is in an operating state.

According to the above electric apparatus, the electric potential of the first terminal provided when the first terminal and the control signal output terminal are short-circuited causes the external output transistor to switch off. When the first terminal and the control signal output terminal are short-circuited during the first power supply circuit is in an operating state, outputting an excess current from the first power supply circuit is configured to be prevented. When the voltage output terminal and the one terminal adjacent to the voltage output terminal are short-circuited during the second power supply circuit is in an operating state, outputting an excess current from the first power supply circuit is configured to be prevented.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
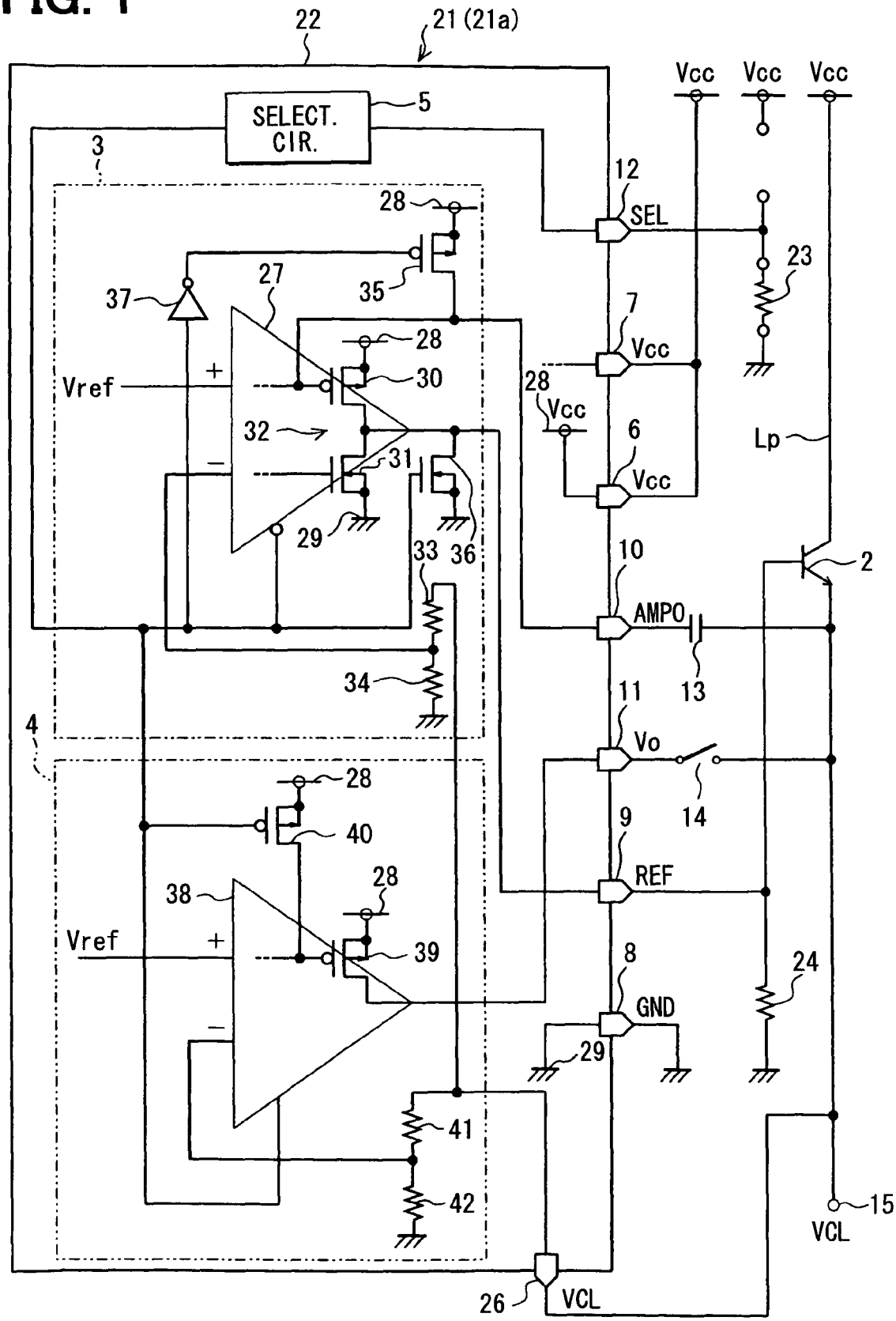
FIG. 1 is a circuit diagram illustrating a configuration of a power supply apparatus according to a first embodiment.
Figure 2:
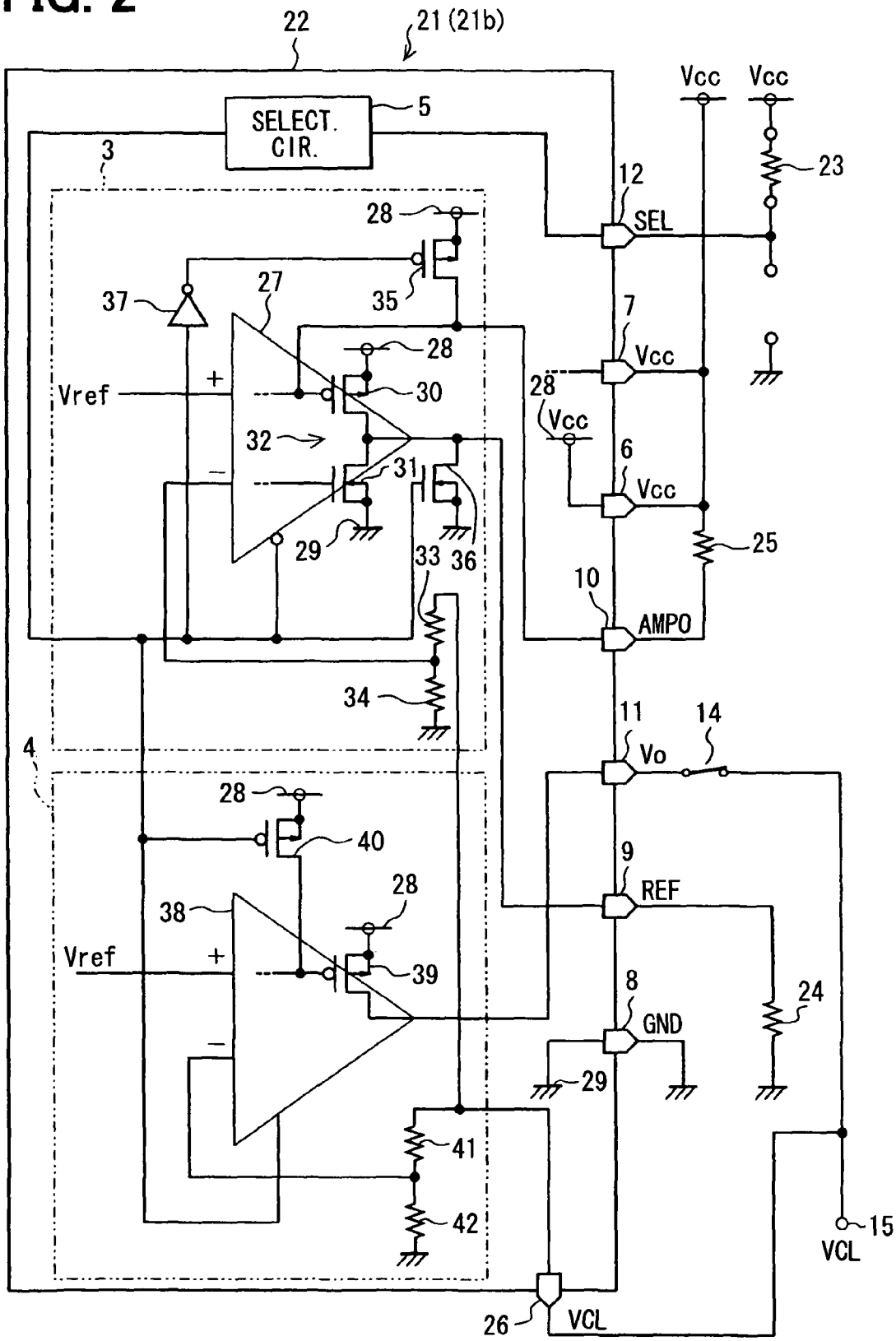
FIG. 2 is a circuit diagram illustrating another configuration of the power supply apparatus according to the first embodiment.

A power supply apparatus 21 according to a first embodiment is described below with reference to FIGS. 1-3. FIGS. 1 and 2 show a configuration of the power supply apparatus 21 built-in an ECU (Electronic Control unit). An IC 22 in the power supply apparatus 21 includes a power supply circuit 3, a power supply circuit 4, and various functional circuits (not shown) of the ECU. The power supply circuit 3 as a first power supply circuit provides a first series regulator in cooperation with an NPN type transistor 2 as an external output transistor. The power supply circuit 4 as a second power supply circuit includes an output transistor as a MOS transistor 39 and provides a second series regulator.

Based on a selection signal SEL, one of the power supply circuits 3, 4 is selected to operate. The un-selected power supply circuit is configured to halt operation. FIG. 1 shows a circuit diagram provided in a case where a power supply apparatus 21 (21A) utilizes the power supply circuit 3. FIG. 2 shows another circuit diagram provided in a case where a power supply apparatus 21 (21B) utilizes the power supply circuit 4.

As shown in FIG. 1, when a selection signal input terminal 12 is connected to ground via a resistor 23, a selection signal SEL having a low level (e.g., 0V) is input to the power supply circuits 3, 4, and then, the power supply circuits 3, 4 switch into an enable state and a disable state, respectively. When the above circuit configuration is adopted, the IC 22, the transistor 2, a capacitor 13 for phase compensation, a switch 14, and resistors 23, 24 are mounted on a substrate. In addition, the switch 14 is configured to be in an off state, and a jumper or a zero ohmic resistor may not be mounted. A power line Lp, which leads from a power source having voltage Vcc to a power output terminal 15, interposes between an emitter and a collector of the transistor 2. The emitter and the collector of the transistor 2 may be also referred to as a first main terminal and a second main terminal, respectively. The resistor 24 pulls a base of the transistor 2 down to ground.

As shown in FIG. 2, when the selection signal input terminal 12 is connected with the power line of the power source Vcc via the resistor, the selection signal SEL having a high level (e.g., 5V) is input to the power supply circuits 3, 4, and then, the power supply circuits 3, 4 switch into the disable state and the enable state, respectively. When the above circuit configuration is adopted, the IC 22, the switch 14, and resistors 23, 24, 25 are mounted on the substrate. In addition, the switch 14 is configured to be in an on state, and a jumper and a zero ohmic resistor may be mounted on the substrate. The resistor 25 pulls a phase compensation input terminal 10 up to the power line having a voltage Vcc.

The IC 22 has, for example, 144-pin QFP. Terminals as pins of the IC 22 relevant to the power supply circuit are high potential side power supply terminals 6, 7, a low potential side power supply terminal 8, a control signal output terminal 9, the phase compensation input terminal 10, a voltage output terminal 11, the selection signal input terminal 12, a voltage detection terminal 26. The high potential side power supply terminals 6, 7 and the low potential side power supply terminal 8 are used for supplying the power source Vcc to the power supply circuit 3, 4 to be energized. The control signal output terminal 9 is used for outputting a control signal REF to the base of the transistor 2. The phase compensation input terminal 10 is used for inputting a phase compensation signal AMPO to the power supply circuit 3 from the emitter of the transistor 2 via the capacitor 13 for phase compensation. The voltage output terminal 11 is used for outputting a power supply voltage Vo to the power output terminal 15 via the switch 14. The selection signal input terminal 12 is used for inputting the selection signal SEL therein. The voltage detection terminal 26 is used for inputting an output voltage Vcl thereto. The voltage detection terminal also functions as an power input terminal for inputting power source to a logic circuit arranged in an inside of the IC 22.

Figure 3:
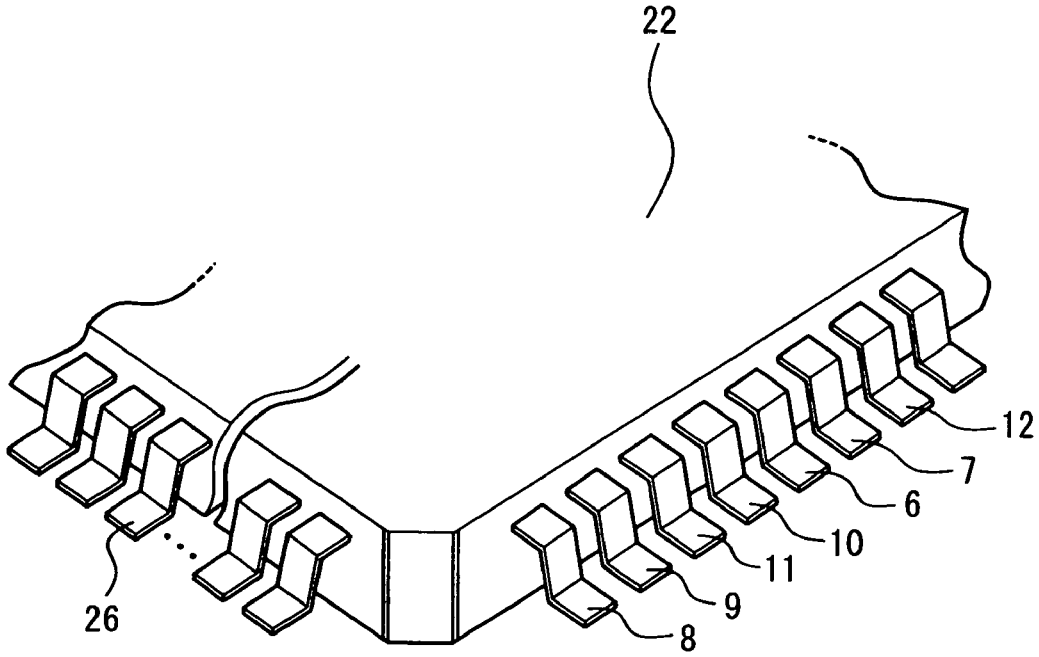
FIG. 3 is an appearance diagram illustrating arrangement of terminals of an IC.

As shown in FIG. 3, the terminals 6-12 are arranged at one side of the QFP in the following order: the low potential side power supply terminal 8, the control signal output terminal 9, the voltage output terminal 11, the phase compensation input terminal 10, the high potential side power supply terminals 6, 7, and the selection signal input terminal 12. The voltage detection terminal 26 is arranged at another side of the QFP.

The power supply circuit 3 includes an operational amplifier 27 for performing constant voltage control. The operational amplifier 27 includes a push-pull output circuit 32 (i.e., push-pull circuit), which has a P channel type MOS (Metal-Oxide Semiconductor) transistor 30 and an N channel type MOS transistor 31. The operational amplifier 27 is connected between a power line 28 and ground 29. An output node of the push-pull circuit 32 is connected with the control signal output terminal 9. A gate of the MOS transistor 30 is connected with the phase compensation input terminal 10. When the selection signal SEL is the L level, the MOS transistors 30, 31 is switchable to ON in accordance with an output signal of a differential amplifier circuit (not shown). When the selection signal SEL is an H (high) level, the MOS transistors 30, 31 is switchable to OFF in accordance with the output signal of the differential amplifier circuit.

A reference voltage Vref, which corresponds to the output voltage Vcl (e.g., 1.5 V), is applied to a non-inverting input terminal of the operational amplifier 27. A detection voltage is applied to an inverting input terminal of the operational amplifier 27. The detection voltage is provided by dividing the output voltage Vcl with voltage divide resistors 33, 34, the output voltage Vcl being input from the voltage detection terminal 26. A P channel type MOS transistor 35 as a first transistor is connected between the power line 28 and the phase compensation input terminal 10. An N channel type MOS transistor 36 as a second transistor is connected between the control signal output terminal 9 and the ground 29. Since gate widths (W) of the MOS transistors 35, 36 are configured to be smaller than that of the MOS transistor 39 and other transistors, capability of outputting a current is limited owing to the gate widths (W).

The gate of the MOS transistor 36 receives the selection signal SEL via a selection circuit 5. The gate of the MOS transistor 35 receives an inverted selection signal SEL via the selection circuit 5 and an inverter 37. The selection circuit 5 includes a protection circuit for protecting the selection signal SEL, which is input from an external unit or circuit.

The power supply circuit 4 includes an operational amplifier 38, which performs constant voltage control. The operational amplifier 38 includes the P channel type MOS transistor 39 as an internal output transistor. The P channel type MOS transistor 39 is connected between the power line 28 and the voltage output terminal 11. When the selection signal SEL is the H level, the MOS transistor 39 is switchable to ON in accordance with the output signal of the differential amplifier circuit (not shown). When the selection signal SEL is the L level, the MOS transistor 39 is switchable to OFF in accordance with the output signal of the differential amplifier circuit (not shown).

A P channel type MOS transistor 40 is connected between the power line 28 and the gate of the MOS transistor 39. A gate of the P channel type MOS transistor 40 receives the selection signal SEL via the selection circuit 5. The reference voltage Vref corresponding to the output voltage Vcl is applied to a non-inverting input terminal of the operational amplifier 38. A detection voltage is applied to an inverting input terminal of the operational amplifier 38. The detection voltage is provided by dividing the output voltage Vcl with voltage divide resistors 41, 42 provides, the output voltage Vcl being input from the voltage detection terminal 26.

Functions of the power supply apparatus 21 according to present embodiment are described below.

As shown in FIG. 1, in one case where the power supply apparatus 21 (21A) is configured with using the power supply circuit 3, the selection signal SEL has the L level and the switch 14 is switched off. In the above state, the MOS transistor is switched on, and the MOS transistors 35, 36, 39 are switched off. The operational amplifier 27 outputs the control signal REF so that the reference voltage Vref is controlled to be approximately equal to the detection voltage. For example, when the output voltage Vcl drops down to a value lower than a target value, a level of the control signal increases, and thereby, a voltage between a collector and an emitter of the transistor 2 decreases and the output voltage Vcl increases.

In the above operational state, short-circuiting between the low potential side power supply terminal 8 and control signal output terminal 9, which are adjacent to each other, causes a base of the transistor 2 to have a ground level. Also, short-circuiting between the phase compensation input terminal 10 and the high potential side power supply terminal 6, which are adjacent to each other, causes the MOS transistor 30 to switch off. As a result, a base current is interrupted, and the transistor 2 is switched off. When the above-described adjacent terminals are short-circuited, electric power supply from the power output terminal 15 to the load (not shown) is interrupted. The load is, for example, a logic circuit.

Since the MOS transistor 39 is in the off state, the voltage output terminal 11 is caused to have a high impedance. In the above case, when the terminals 9, 11 or the terminals 10, 6 are short-circuited, the power supply circuit 3 maintains an normal operation without the control signal REF and the phase compensation signal AMPO being influenced by, for example, the short-circuit. The terminals 9, 11 are arranged adjacent to each other and the terminals 10, 6 are arranged adjacent to each other.

In another case where the power supply apparatus 21 (21*b*) utilizes the power supply circuit 4, as shown in FIG. 2, the selection signal SEL is switched to the H level, and the switch 14 is switched on. In the above state, the MOS transistors 35, 36, 39 are switched on, and the MOS transistors 30, 31, 40 are switched off. A level of the control signal output terminal 9 is fixed to the ground level through the MOS transistor 36 and the external resistor 25. The operational amplifier 38 controls a gate voltage of the MOS transistor 39 so that the reference voltage Vref is approximately equal to the detection voltage.

In the above operational state, when the control signal output terminal 9 and the voltage output terminal 11, which are adjacent to each other, are short-circuited, a current flows from the power line through the MOS transistor 39, the voltage output terminal 11, the control signal output terminal 9, and the MOS transistor 36. When the phase compensation input terminal 10 and the voltage output terminal 11, which are adjacent terminal to each other, are short-circuited, a current flows from the power line 28 to the load through the MOS transistor 35, the phase compensation input terminal 10, and the voltage output terminal 11. Since the MOS transistors 35, 36 have a limited capability of outputting a current as described above, the current flow in the above cases is limited. Therefore, an excess voltage and an excess current are not configured to be output.

The IC 22 according to the present embodiment is configured to drive the NPN type transistor 2 with using the power supply circuit 3 and has the terminals, which are arranged in the following manners. The low potential side power supply terminal is arranged adjacent to the control signal output terminal 9, which is relative to the power supply circuit 3. The high potential side power supply terminal 6 is arranged adjacent to the phase compensation input terminal 10, which is relative to the power supply circuit 3. The voltage output terminal 11 relative to the power supply circuit 4 is arranged between the control signal output terminal 9 and the phase compensation input terminal 10.

When the power supply apparatus 21 is configured with utilizing the IC 22, outputting an excess voltage and an excess current is reliably prevented even if the adjacent terminals are short-circuited owing to, for example, formation of a solder bridge or attachment of an dust particle having electric conductivity. Thus, it is possible to protect the ECU itself and the load such as a logic circuit and a microcomputer. Furthermore, an advantage is provided in that it is easier to narrow a pitch between terminals of the IC 22.

Second Embodiment

Figure 4:
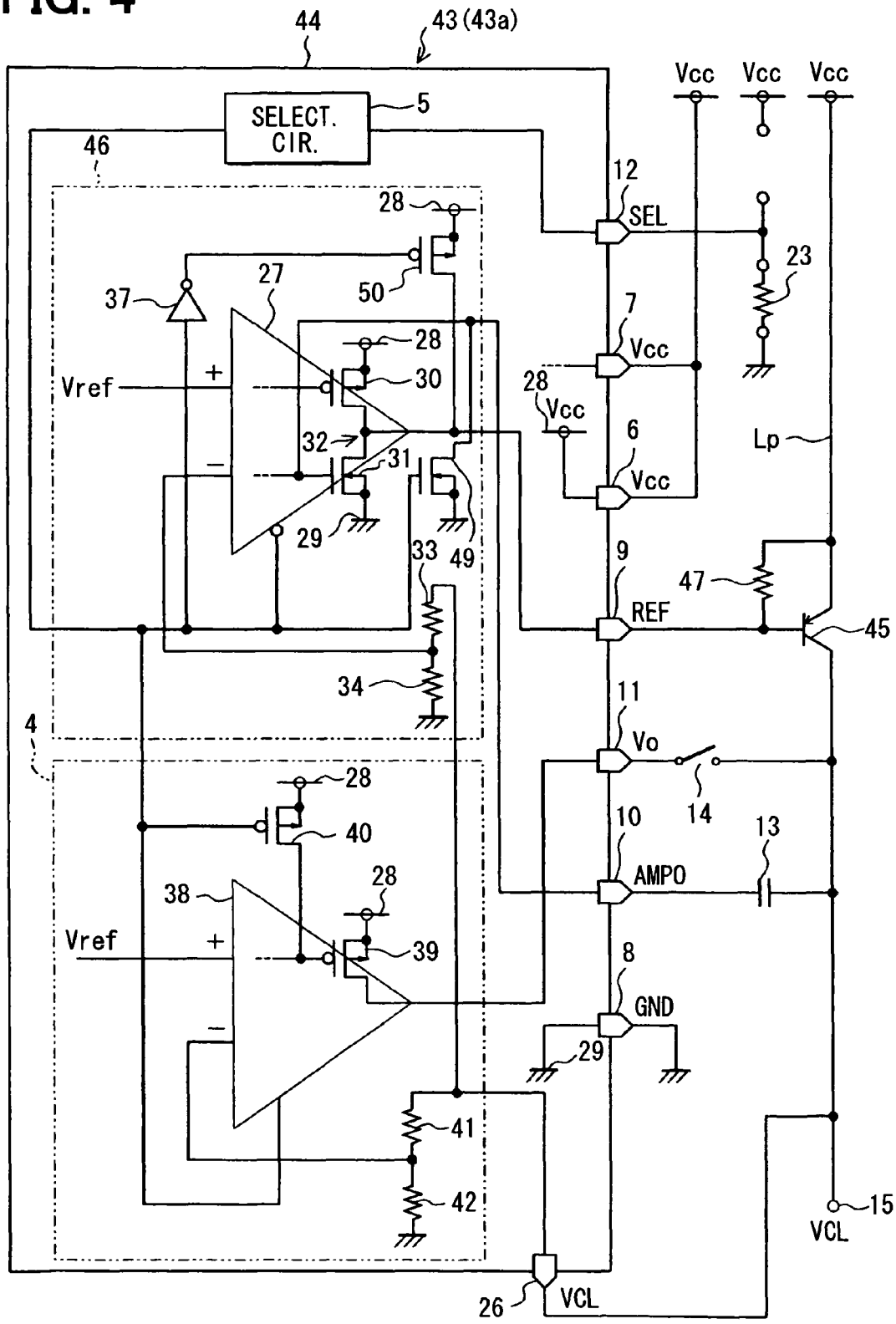
FIG. 4 is a circuit diagram illustrating a configuration of a power supply apparatus according to a second embodiment.
Figure 5:
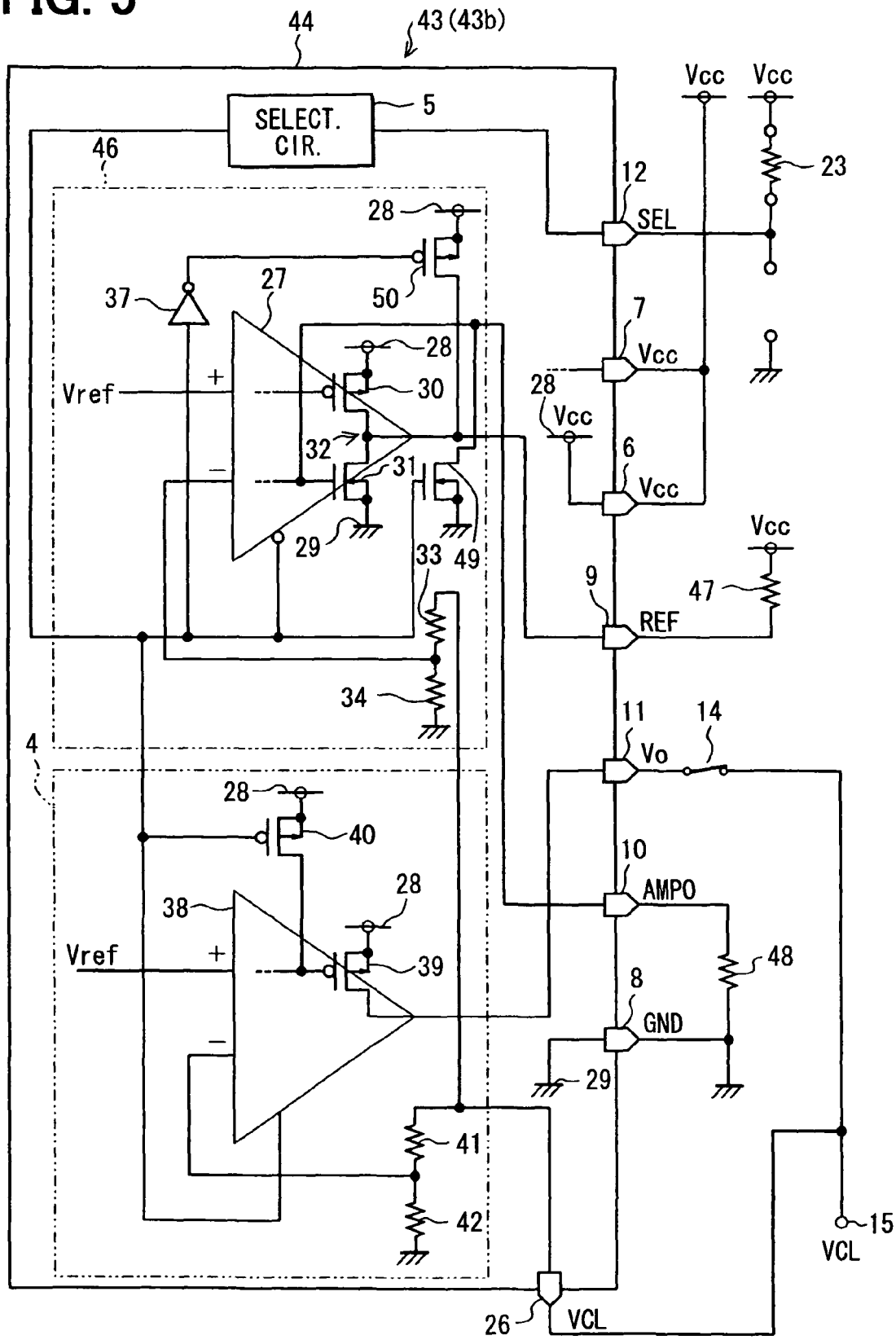
FIG. 5 is a circuit diagram illustrating another configuration of the power supply apparatus according to the second embodiment.

A power supply apparatus 43 according to a second embodiment is described below with reference to FIGS. 4 and 5. FIGS. 4, 5 show a configuration relative to the power supply apparatus 43 built-in the ECU for a vehicle. The power supply apparatus 43 comprises an IC 44, which includes a power supply circuit 46, the power supply circuit 4 and various functional circuits of the ECU. The power supply circuit 46 as the first power supply circuit provides a first series regulator in cooperation with a PNP type transistor 45 as the external output transistor. FIG. 4 shows a circuit configuration in which a power supply apparatus 43 (43A) utilizes the power supply circuit 46. FIG. 4 shows a circuit configuration in which a power supply apparatus 43 (43B) utilizes the power supply circuit 4.

As shown in FIG. 4, when the selection signal having the L level is input to the power supply circuit 46 and the power supply circuit 4, the power supply circuits 46, 4 are switched into the enable state and the disable state, respectively. When the above circuit configuration is adopted, the IC 44, the transistor 45, the capacitor 13, the switch 14, and resistors 23, 47 are mounted on a substrate. In addition, the switch 14 is switched off. A power line Lp is interposed between an emitter and a collector of the transistor 45. The emitter and the collector of the transistor 45 correspond to a first main terminal and a second main terminal, respectively. The resistor 47 is connected between the emitter and a base of the transistor 45. The capacitor 13 for phase compensation is connected between a collector of the transistor 45 and the phase compensation input terminal 10.

As shown in FIG. 5, when the selection signal SEL having the H level is input to the power supply circuits 46, 4, the power supply circuits 46, 4 switch into the disable state and the enable state, respectively. When the above configuration is adopted, the IC 44, the switch 14, and resistors 23, 47, 48 are mounted on the substrate. In addition, the switch 14 is switched on. The resistor 48 pulls down the phase compensation input terminal 10 to ground.

The terminals 6-12 is arranged at one side of the QFP in the following order: the low potential side power supply terminal 8, the phase compensation input terminal 10, the voltage output terminal 11, the control signal output terminal 9, the high potential side power supply terminals 6,7, and the selection signal input terminal 12.

A gate of the MOS transistor 31 in the power supply circuit 46 is connected with the phase compensation input terminal 10. An N channel type MOS transistor 49 as the first transistor is connected between the phase compensation input terminal 10 and the ground 29. A P channel type MOS transistor 50 as a second transistor is connected between the power line 28 and the control signal output terminal 9. The MOS transistors 49, 50 have a limited capability of outputting a current, similarly to the above-described case of the MOS transistors 35, 36.

Functions of the power supply apparatus 43 according to the present embodiment are described below.

In a case where the power supply apparatus 43 (43A) utilizes the power supply circuit 46, as shown in FIG. 4, the selection signal SEL has the L level, and the switch 14 is switched off. In the above state, the MOS transistor 40 is switched on, and the MOS transistors 39, 49, 50 are switched off. When the control signal output terminal 9 and the high voltage side power supply terminal 6, which are adjacent to each other, are short-circuited in the above operational state, a base of the transistor 45 has a voltage level Vcc. As a result, the transistor 45 is switched off. When the low potential side power supply terminal 8 and the phase compensation input terminal 10, which are adjacent to each other, are short-circuited, the MOS transistor 31 is switched off. As a result, a base current is interrupted, which switches off the transistor 45. Specifically, short-circuiting between the above adjacent terminals interrupts electric power supply from the power output terminal 15 to the load.

Since the MOS transistor 39 is in the off state, when the terminals 9, 11 or the terminals 10, 11 are short-circuited, the power supply circuit 46 maintains an normal operation without the control signal REF and the phase compensation signal AMPO being influenced by the short-circuiting. The terminals 10, 11 are adjacent to each other and the terminals 9, 11 are adjacent to each other.

When the power supply apparatus 43 (43B) utilizes the power supply circuit 4, as shown in FIG. 5, the selection signal SEL has the H level, and the switch 14 is switched off. In the above state, the MOS transistor 39, 49, 50 are switched on, and the MOS transistors 30, 31, 40 are switched off. A level of the control signal output terminal 9 is fixed to the Vcc level through the MOS transistor 50 and an external resistor 47. A level of the phase compensation input terminal 10 is fixed to the ground level through the MOS transistor 49 and the external resistor 48.

In the above operational state, when the control signal output terminal 9 and the voltage output terminal 11, which are adjacent to each other, are short-circuited, the following two current flows: one is that a current flows from the power line 28 through the MOS transistor 50, the control signal output terminal 9, and the voltage output terminal 11; and the other is that a current flows from the power line of Vcc through the resistor 47, the control signal output terminal 9, and the voltage output terminal 11. When the phase compensation input terminal 10 and the voltage output terminal 11, which are adjacent to each other, are short-circuited, a current flows from the power line 28 through the MOS transistor 39, the voltage output terminal 11, the phase compensation input terminal 10, the MOS transistor 49, or the resistor 48. In the above case, however, since the MOS transistors 49, 50 have a limited capability of outputting a current, and since the resistors 47, 48 are set to have large resistances, the current is limited. Therefore, an excess current and an excess voltage are configured not to output.

The IC 44 is capable of driving the PNP type transistor 45 with using the power supply circuit 46. In the IC 44, the low potential side power supply terminal 8 is arranged adjacent to the phase compensation input terminal 10, which is relative to the power supply circuit 46. The high potential side power supply terminal 6 is arranged adjacent to the control signal output terminal 9, which is relative to the power supply circuit 46. The voltage output terminal 11, which is relevant to the power supply circuit 4, is arranged between the control signal output terminal 9 and the phase compensation input terminal 10. The use of the IC 22 for the series-regulator-typed power supply apparatus 43 reliably prevents outputting an excess current and an excess voltage when adjacent terminals are short-circuited.

Third Embodiment

A power supply apparatus 51 according to a third embodiment is described below with reference to FIGS. 6A-6C and 7.

Figure 6A:
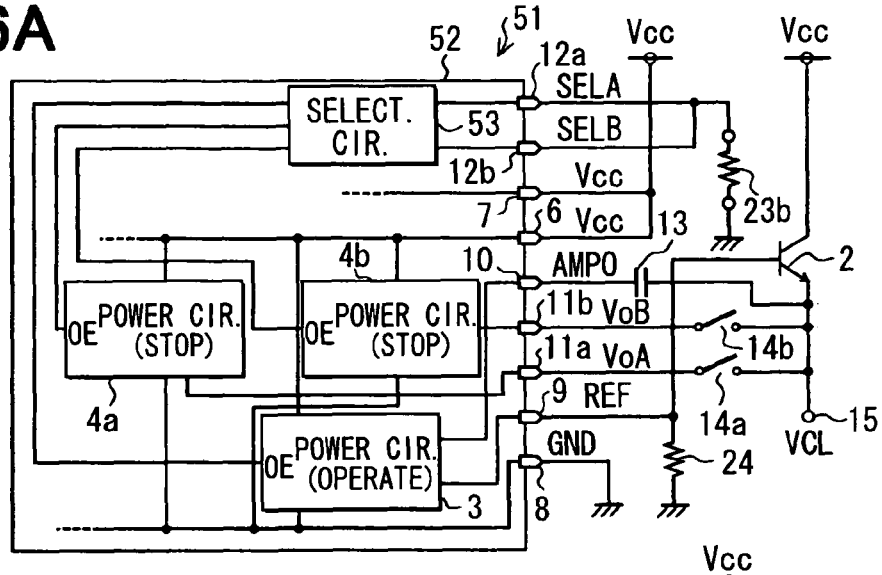
FIGS. 6A, 6B, 6C are circuit diagrams illustrating configurations relative to switching a power supply circuit according to a third embodiment.
Figure 6B:
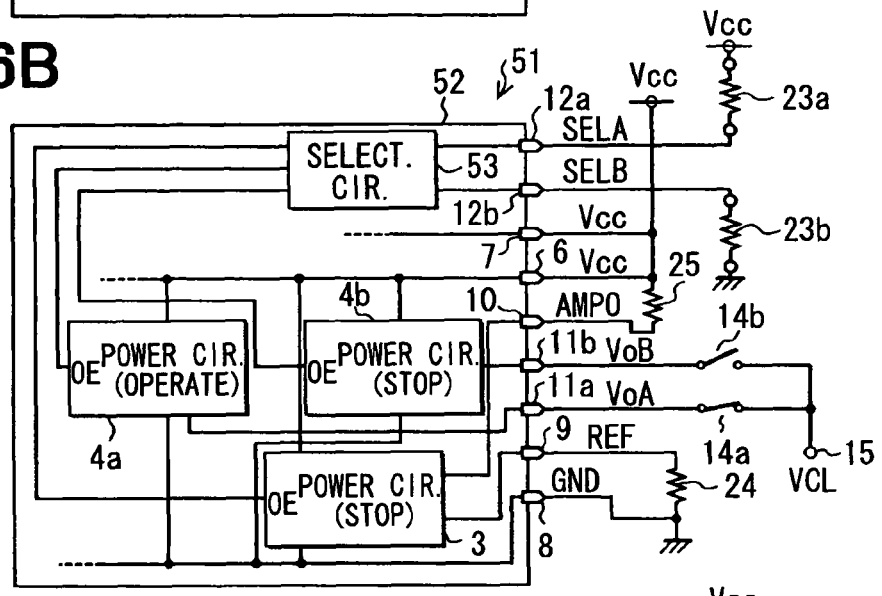
Figure 6C:
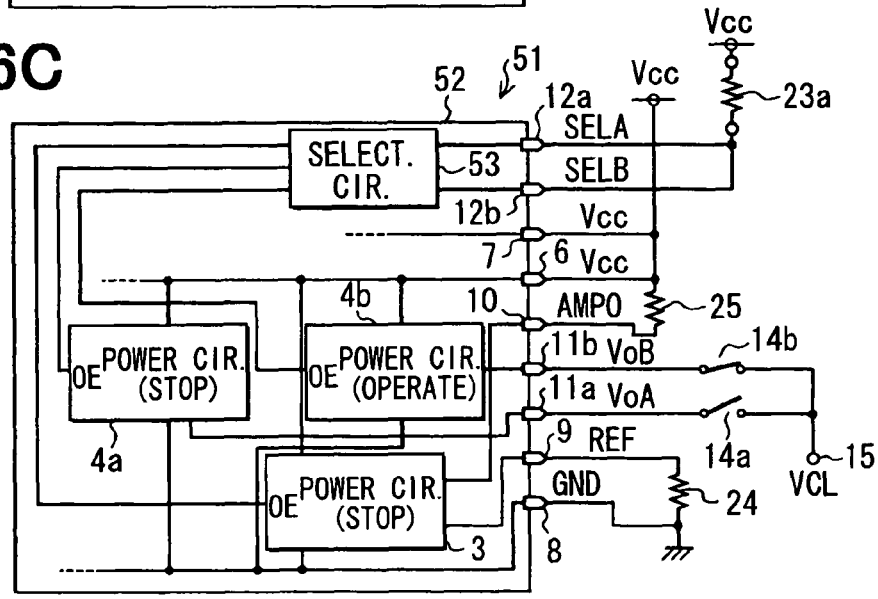
Figure 7:
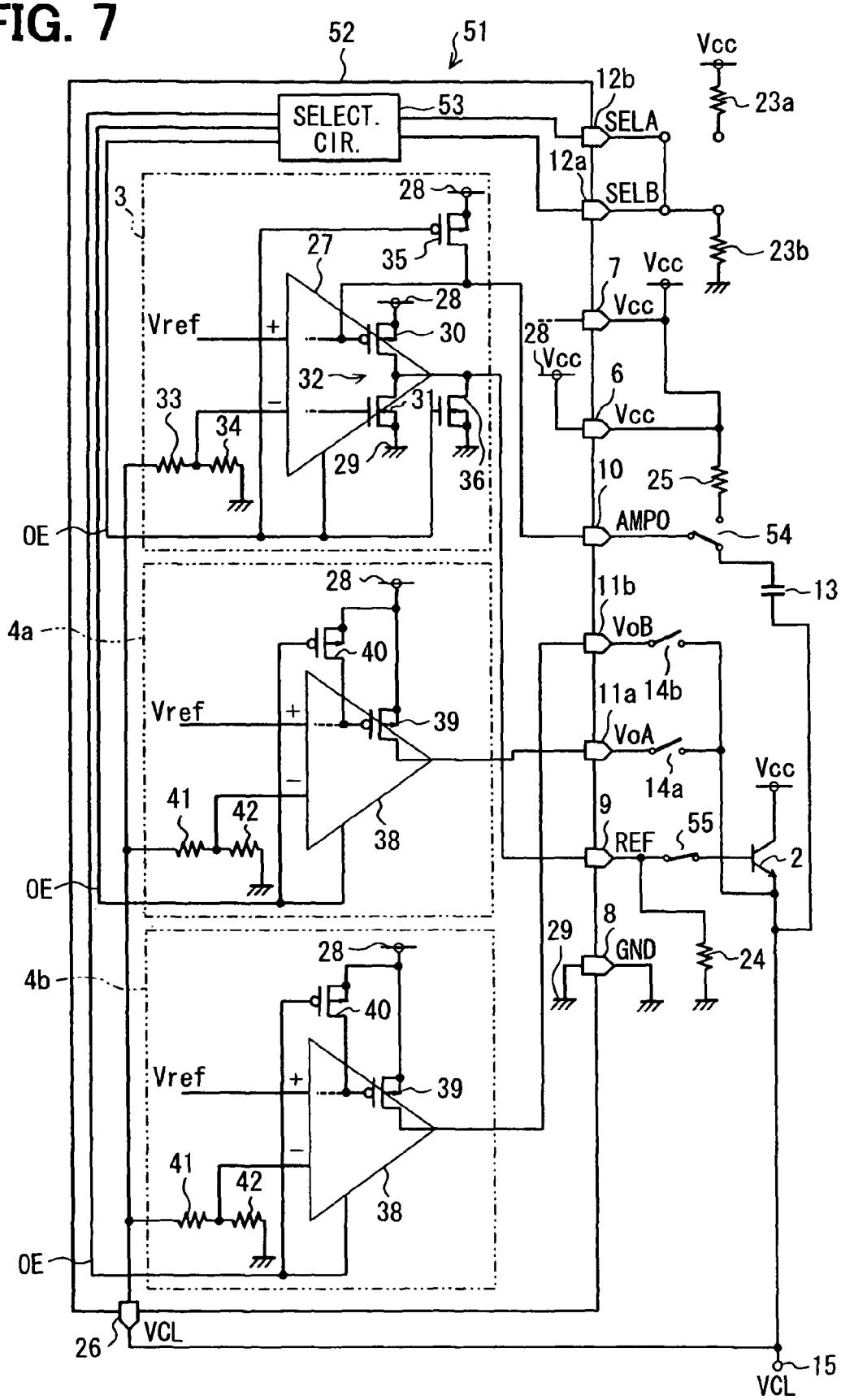
FIG. 7 is a circuit diagram illustrating a configuration of a power supply apparatus according to the third embodiment.

The power supply apparatus 51 built in the ECU for a vehicle includes an IC 52. The IC 52 includes a power supply circuit 3 as the first power supply circuit and two power supply circuits 4*a*, 4*b*. The two power supply circuits 4*a*, 4*b* correspond to second and third power supply circuits, respectively. FIG. 6A shows a circuit configuration provided in case where only the power supply circuit 3 operates. FIG. 6B shows a circuit configuration provided in case where only the power supply circuit 4*a* operates. FIG. 6C shows a circuit configuration provided in case where only the power supply circuit 4*b* operates. Each power supply circuit 4*a*, 4*b* according to the present embodiment is substantially identical to the power supply circuit 4 according to the first embodiment. The power supply circuit 3 includes the operational amplifier 27. The operational amplifier 27 includes the MOS transistors 30, 31. Each power supply circuit 4*a*, 4*b* includes the operational amplifier 38. The operational amplifier 38 includes a MOS transistor 39. When a control signal OE has an H level, the MOS transistors 30, 31, 39 are capable of being in the on state. When a control signal OE has a L level, the MOS transistors 30, 31, 39 are switched off.

Selection signals SELA and SELB are input to terminals 12*a* and 12*b*. Based on the selection signals SELA, SELB, one circuit is selected from among the power supply circuits 3, 4*a*, 4*b* to operate. The un-selected power supply circuits are configured to halt and stop operation. The selection signals SELA, SELB are input to a selection circuit 53, which produces the control signal OE for selecting the power supply circuit. The control signal OE may be selected at the H level. Resistors 23A, 23B for production of the selection signals SELA, SELB are mounted on a substrate, to which the IC 22 is mounted.

By switching a switch 54, the phase compensation input terminal 10 is pull up to a power line having a voltage Vcc via the resistor 25, or, the phase compensation input terminal 10 is connected with an emitter of the transistor 2 and the power output terminal 15 via the capacitor 13 for phase compensation. Voltage output terminals 11*a*, 11*b* are connected with the power output terminal 15 via the switches 14*a*, 14*b*, respectively. The voltage output terminals 11*a*, 11*b* are used for outputting power supply voltages from the MOS transistors 39 in the power supply circuits 4*a*, 4*b*, respectively. The control signal output terminal 9 for outputting the control signal REF from the push-pull circuit 32 of the power supply circuit 3 to a base of the transistor 2 is pull down to ground via the resistor 24. The control signal output terminal 9 is connected with the base of the transistor 2 via a switch 55. In the present embodiment, switches 14*a*, 14*b*, 54, 55 are used. Alternatively, a semiconductor switching element or a jumper line may be used instead of the switches 14*a*, 14*b*, 54, 55.

In the present embodiment, the terminals 6-12 are arranged at one side of the QFP (cf. FIG. 3) in the following order: the low potential side power supply terminal 8, the control signal output terminal 9, the voltage output terminals 11*a*, 11*b*, the phase compensation input terminal 10, the high potential side power supply terminals 6, 7, and the selection signal input terminals 12*b*, 12*a*. Alternatively, the voltage output terminals 11*a*, 11*b* may be arranged in reverse order compared to the above arrangement.

As shown in FIG. 6A, when the signal SELA and SELB are in the low level, only the power supply circuit 3 is switched into the enable state. In the above case, the switch 54 (shown in FIG. 7 and not shown in FIGS. 6A-6C) is switched to a position to have connection with the capacitor 13. Further, the switches 14*a*, 14*b* are switched off, and the switch 55 (not shown in FIGS. 6A-6A but shown in FIG. 7) is switched on. In the above operational state, when the terminals 8, 9 or the terminals 10, 6, are short-circuited, the transistor 2 is switched off. The terminals 8, 9 are adjacent to each other and the terminals 10, 6 are adjacent to each other. Since the MOS transistor 39 is in the off state, each voltage output terminal 11*a*, 11*b* has high impedance. Therefore, when the adjacent terminals 9, 11*a* or the adjacent terminals 10, 11*b* are short-circuited, the control signal REF and the phase compensation signal AMPO is not influenced and the power supply circuit 3 can maintain a normal operation.

As shown in FIG. 6B, when the selection signal SELA is in the high level and the selection signal SELB is in the low level, only the power supply circuit 4*a* is switched into the enable state. In the above case, the switch 54 is switched to a position to have connection with the pull-up resistor 25. Further, the switch 14*a* is switched on, and the switches 14*b*, 55 are switched off. In the above operational state, when the control signal output terminal 9 and the voltage output terminal 11*a* adjacent to each other are short-circuited, a current flows from the power line 28 through the MOS transistor 39, the voltage output terminal 11*a*, the control signal output terminal 9, and the MOS transistor 36. Since the MOS transistor 36 has a limited capability of inputting and outputting a current, the current flow is limited. Further since the voltage output terminal 11*b* is caused to have high impedance, short-circuiting between two adjacent voltage output terminals 11*b*, 11*a* does not influence an output voltage of the power supply circuit 4*a*.

As shown in FIG. 6C, when the selection signals SELA and SELB are in the high level, only the power supply circuit 4*b* is switched into the enable state. In the above case, the switch 54 is switched to a position to have connection with the pull-up resistor 25. Further, the switch 14*b* is switched on, and the switches 14*a*, 55 are switched off. In the above operational state, when the phase compensation input terminal 10 and the voltage output terminal 11 adjacent to each other are short-circuited, a current flows from the power line 28 to the load through the MOS transistor 35, the phase compensation input terminal 10, and the voltage output terminal 11*b*. Since the MOS transistor 35 has a limited capability of inputting and outputting a current, the current is limited. Further, since the voltage output terminal 11*a* is caused to be high impedance, the short-circuiting between two adjacent voltage output terminals 11*a*, 11*b* does not influence an output voltage of the power supply circuit 4*b*.

As is described above, the IC 52 according to the present embodiment includes the power supply circuit 3 and the two power supply circuits 4*a*, 4*b*, among which only one power supply circuit is configured to operate. Since the terminals of the IC 52, which are relevant to the above power supply circuits, are arranged in the above-described order, outputting an excess voltage and an excess current is reliably prevented even if the adjacent terminals short-circuit owing to attachment of dust having electric conductivity or formation of a solder bridge in mounting the IC 52 to the substrate. Further, an advantage is provided in that it is easier to narrow a pitch between terminals.

Fourth Embodiment

A power supply apparatus 56 according to a fourth embodiment is described below with reference to FIG. 8.

Figure 8:
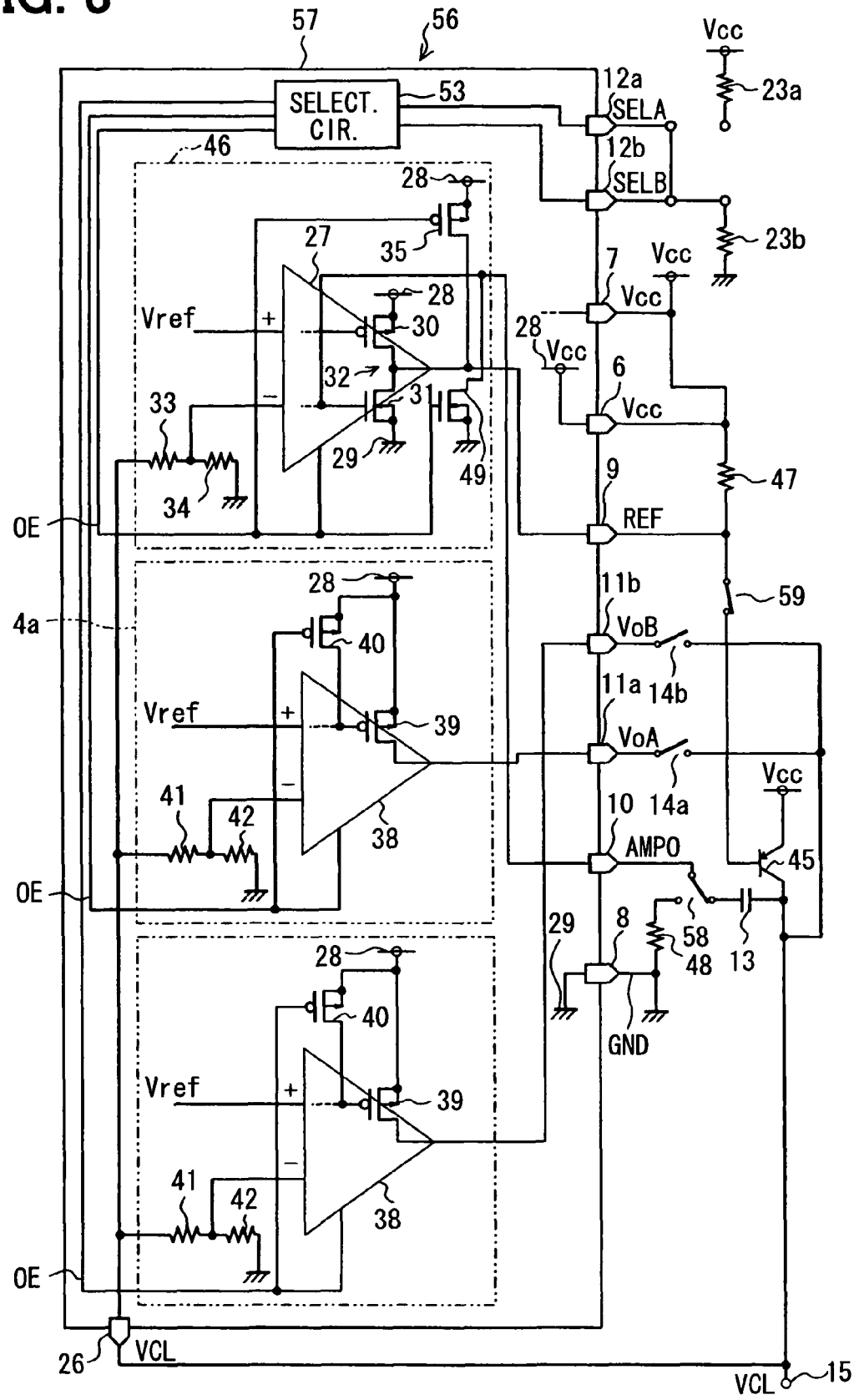
FIG. 8 is a circuit diagram illustrating a configuration of a power supply apparatus according to a fourth embodiment.
Figure 9:
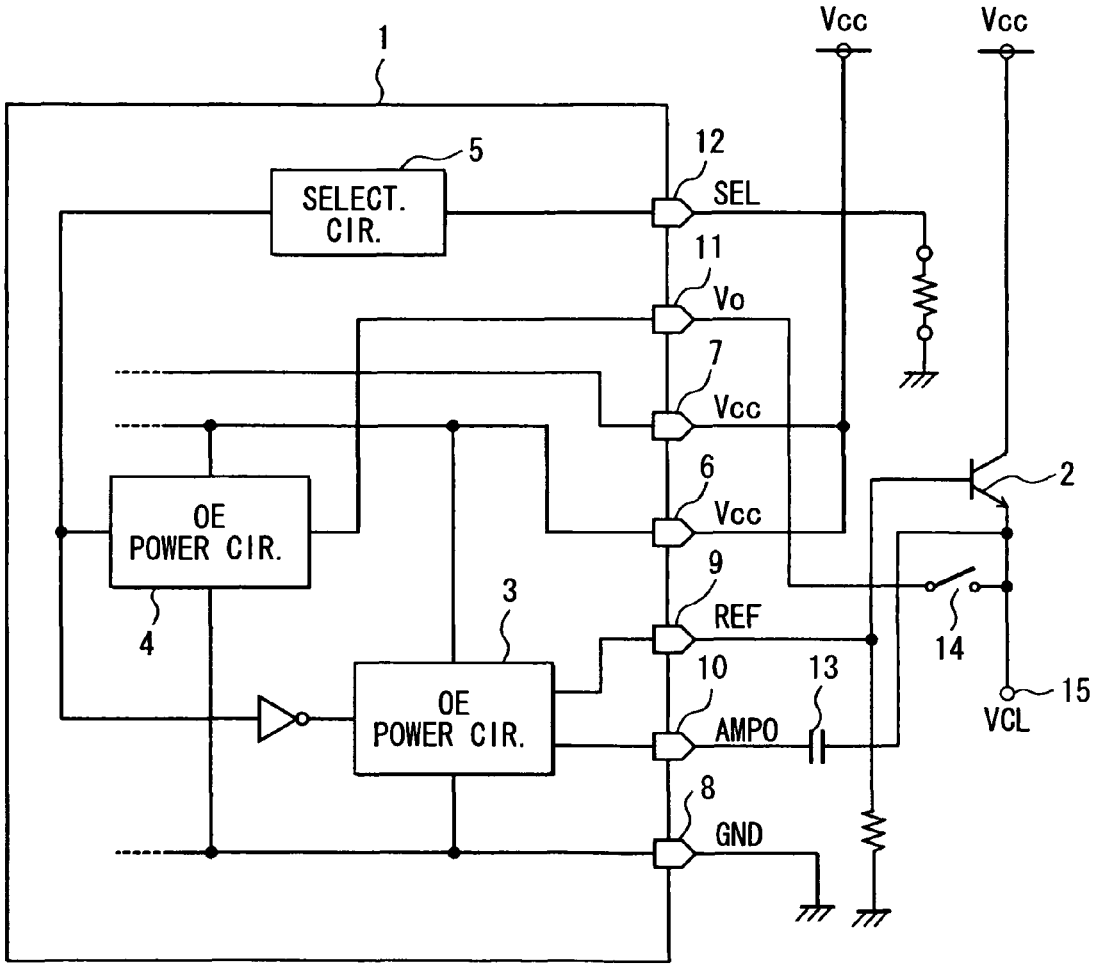
FIG. 9 PRIOR ART
FIG. 9 is a circuit diagram illustrating a series regulator according to the prior art.

FIG. 8 shows a configuration relevant to the power supply apparatus 56 built in the ECU for a vehicle. The power supply apparatus 56 comprises an IC 57, which includes a power supply circuit as the first power supply circuit and the two power supply circuits 4*a*, 4*b*. The two power supply circuits 4*a*, 4*b* correspond to the second and third power supply circuit, respectively. One power supply circuit is selected among the power supply circuits 46, 4*a*, 4*b* based on the selection signals SELA, SELB. The selected one power supply circuit is configured to operate. Terminals of the IC 57 are arranged at a side of the QFP (c.f. FIG. 3) in the following order: the low potential side power supply terminal 8, the phase compensation input terminal 10, the voltage output terminals 11*a*, 11*b*, the control signal output terminal 9, the high potential side power supply terminals 6, 7, the selection signal input terminals 12*b*, 12*a*. Alternatively, positions of the voltage output terminals 11*a*, 11*b* may be replaced with each other.

When the selection signals SELA and SELB are in the low level, only the power supply circuit 46 is switched into the enable state. In the above case, a switch 58 is switched to a position to have connection with the capacitor 13 for phase compensation. Further, the switches 14*a*, 14*b* are switched off, and a switch 59 is switched on. In the above operational state, when the adjacent terminals 9, 6 or the adjacent terminals 8, 10 are short-circuited, the transistor 45 is switched off. When the adjacent terminals 10, 11*a* or the adjacent terminals 9, 11*b* are short-circuited, the power supply circuit maintains a normal operation while the phase compensation signal AMPO and the control signal REF are not influenced by the short-circuiting.

When the selection signal SELA is in the high level and the selection signal SELB is in the low level, only the power supply circuit 4*b* is switched into the enable state. In the above case, the switch 58 is switched to a position to have connection with the pull-down resistor 48. Further, the switch 14*a* is switched on, and the switches 14*b*, 59 are switched off. In the above operational state, when the phase compensation input terminal 10 and the voltage output terminal 11*a* adjacent to each other are short-circuited, a current flows from the power line 28 through the MOS transistor 39, the voltage output terminal 11*a*, the phase compensation input terminal 10, the MOS transistor 49 or the resistor 48. Since the MOS transistor 49 has a limited capability of inputting and outputting a current, the current is limited. Further, since the voltage output terminal 11*b* is caused to be high impedance, the short-circuiting between the adjacent voltage output terminals 11*b*, 11*a* does not influence an output voltage of the power supply circuit 4*a*.

When the signals SELA and SELB are in the high level, only the power supply circuit 4*b* is switched into the enable state. In the above case, the switch 58 is switched to a position to have connection with the pull-down resistor 48. Further, the switch 14*b* is switched on, and the switches 14*a*, 59 are switched off. In the above operational state, when the control signal output terminal 9 and the voltage output terminal 11*b* adjacent to each other are short-circuited, a current flows from the power line 28 through the MOS transistor 50, the control signal output terminal 9, and the voltage output terminal 11*b*, or a current flows from the power line of Vcc through a resistor 47, the control signal output terminal 9, and the voltage output terminal 11*b*. Since the MOS transistor 50 has a limited capability of inputting and outputting a current, the current is limited. Further, since the voltage output terminal 11*a* is caused to have high impedance, short-circuiting between two adjacent voltage output terminals 11*a*, 11*b* does not influence an output voltage of the power supply circuit 4*b*.

As is described above, the IC 57 according to the present embodiment includes the power supply circuit 3 and the two power supply circuits 4*a*, 4*b*, among which only one power supply circuit is configured to operate. The terminals of the IC 52, which are relevant to the above power supply circuits, are arranged in the following order: the low electric potential side power supply terminal 8, the phase compensation input terminal 10, the voltage output terminals 11*a*, 11*b*, the control signal output terminal 9, the high electric potential side power supply terminals 6, 7, and the selection signal input terminals 12*b*, 12*a*. Therefore, an advantage almost identical to that according to above-described embodiments is provided.

Other Embodiments

In the above description, a bipolar transistor provides the external output transistor. Alternatively, a field effect transistor (FET) may provide the external output transistor. More specifically, in the first and third embodiments, an n-channel type FET may be used instead of the NPN type transistor 2. Also, in the second and fourth embodiments, a p-channel type FET may be used instead of the PNP type transistor. In the above alternative configurations, the first and second main terminals may be, respectively, provided by a drain and a source of the FET, or the source and the drain of the FET.

In an alternative configuration of the first embodiment, the IC 22, the transistor 2, the capacitor 13 for phase compensation, the switch 14, and the resistors 23, 24, 25 may be mounted on the substrate. The circuit configuration shown in FIG. 1 and the circuit configuration shown in the FIG. 2 may be configured to be switched by, for example a switch.

In an alternative configuration of the second embodiment, the IC 44, the transistor 45, the capacitor 13, the switch 14, and the resistors 23, 47, 48 may be mounted on the substrate. The circuit configuration shown in FIG. 4 and the circuit configuration shown in the FIG. 5 may be configured to be switched to each other by, for example a switch.

The MOS transistors 35, 36, 49, 50 as the first and second transistors may be arranged if necessary.

The configuration according to the first and second embodiments includes a case where one first power supply circuit and one second power supply circuit are built-in the IC. The configuration according to the first and second embodiments includes a case where multiple power supply circuits including at least one first power supply circuit and at least one second power supply circuit may be built-in the IC. In the above configuration, when terminals arranged in a similar manner to that according to the first and second embodiments, similar function and advantage are provided. In the third embodiment, the IC includes one first power supply circuit and two second power supply circuits. Alternatively, the IC may include at least one or more first power supply circuit and at least one or more second power supply circuit. When the external output transistor is provided by the NPN or N channel type transistor, terminals may be adjacently arranged in the following order: the low electrical potential side power supply circuit, the control signal output terminals of multiple first power supply circuits, the voltage output terminals of multiple second power supply circuits. When the external output transistor is provided by the PNP or P channel type transistor, terminals may be arranged in the following order: the low electrical potential side power supply terminal, the phase compensation terminals of multiple first power supply circuits, the voltage output terminals of multiple second power supply circuits, the control signal output terminals of the multiple power supply circuits, the high electrical potential side power supply terminal. When the IC includes multiple first power supply circuits, multiple external output transistors for each first power supply circuit may be provided, or one external output transistor for the multiple first power supply circuits may be provided.

At least one of or both of the high and low electric potential side power supply terminals 6, 8 is arranged adjacent to the control signal output terminal 9, and provides a power supply terminal that causes the output transistor 2, 45 to be in an off state when the control signal output terminal 9 and the one of the high and low electric potential side power supply terminals 6, 8 short-circuit.

At least one of or both of the plurality of terminals, the one which is arranged adjacent to one of the voltage output terminals 11, 11*a*, 11*b*, may provide a high impedance terminal or an input and output current limit terminal when the power supply circuit 4, 4*a*, 4*b* is in an operating state.

In the above description, the QFP is used for packaging the IC. Alternatively, other packaging such as DIP, QUIP, SIP, ZIP, SOP, SOJ, and QFJ (PLCC) may be used for packaging the IC.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An electric apparatus comprising:

an external output transistor to be coupled with an external unit; and a semiconductor integrated circuit device for controlling the external output transistor, the semiconductor integrate circuit device including (i) a first power supply circuit that includes an output circuit, and that provides a first series regulator in cooperation with the external output transistor, (ii) a second power supply circuit that includes an internal output transistor, and that provides a second series regulator, and (iii) a plurality of terminals, wherein:

the plurality of terminals includes (i) a control signal output terminal for outputting a control signal from an output node of the output circuit of the first power supply circuit to a control terminal of the external output transistor, (ii) a voltage output terminal for outputting a power supply voltage from the internal output transistor of the second power supply circuit, and (iii) a high electric potential side power supply terminal and a low electric potential side power supply terminal for supplying electric power to the first and second power supply circuits, the electric power being used as operating power of the first and second power supply circuits;

at least one of the high and low electric potential side power supply terminals is arranged adjacent to the control signal output terminal and defined as a first terminal;

short-circuiting between the control signal output terminal and the first terminal short-circuit causes the external output transistor to switch into an off state; and at least one of the plurality of terminals, the one which is arranged adjacent to the voltage output terminal, provides a high impedance terminal or an input and output current limit terminal when the second power supply circuit is in an operating state, wherein the external output transistor is an NPN type transistor or an N channel type transistor;

the external output transistor includes a first main terminal and a second main terminal, which are provided in a power line leading to an external power source output terminal;

the plurality of terminals is adjacently arranged in the following order: the low electric potential side power supply terminal, the control signal output terminal, and the voltage output terminal, the plurality of terminals further includes a phase compensation input terminal for inputting a phase compensation signal to the output circuit of the first power supply circuit from the second main terminal of the external output transistor;

the output circuit of the first power supply circuit includes a push-pull circuit;

the push-pull circuit is connected between the high electrical potential side power supply terminal and the low electric potential side power supply terminal;

the push-pull circuit includes a P channel or PNP type transistor and an N channel or NPN type transistor;

the output node of the output circuit is connected between the P channel or PNP type transistor and the N channel or NPN type transistor;

the phase compensation signal is input to a control terminal of the P channel or PNP type transistor; and the plurality of terminals is adjacently arranged in the following order: the low electric potential side power supply terminal, the control signal output terminal, the voltage output terminal, the phase compensation input terminal, and the high electric potential side power supply terminal.

2. The electric apparatus according to claim 1, further comprising:

a first transistor that is connected between the high electric potential side power supply terminal and the phase compensation input terminal; and a second transistor that is connected between the control signal output terminal and the low electric potential side power source input terminal, wherein the first and second transistor have a limited capability of outputting a current, and the first and second transistors are controlled so as to be in an on state when the first power supply circuit is in a non-operating state.

3. An electric apparatus comprising:

an external output transistor to be coupled with an external unit; and a semiconductor integrated circuit device for controlling the external output transistor, the semiconductor integrate circuit device including (i) a first power supply circuit that includes an output circuit, and that provides a first series regulator in cooperation with the external output transistor, (ii) a second power supply circuit that includes an internal output transistor, and that provides a second series regulator, and (iii) a plurality of terminals, wherein:

the plurality of terminals includes (i) a control signal output terminal for outputting a control signal from an output node of the output circuit of the first power supply circuit to a control terminal of the external output transistor, (ii) a voltage output terminal for outputting a power supply voltage from the internal output transistor of the second power supply circuit, and (iii) a high electric potential side power supply terminal and a low electric potential side power supply terminal for supplying electric power to the first and second power supply circuits, the electric power being used as operating power of the first and second power supply circuits;

at least one of the high and low electric potential side power supply terminals is arranged adjacent to the control signal output terminal and defined as a first terminal;

short-circuiting between the control signal output terminal and the first terminal short-circuit causes the external output transistor to switch into an off state; and at least one of the plurality of terminals, the one which is arranged adjacent to the voltage output terminal, provides a high impedance terminal or an input and output current limit terminal when the second power supply circuit is in an operating state, the external output transistor is a P channel or PNP type transistor;

the external output transistor includes a first main terminal and a second main terminal, which are provided in a power line leading to an external power source output terminal; and the plurality of terminals is arranged in order of the voltage output terminal, the control signal output terminal, and the high electrical potential side power supply terminal.

4. The electric apparatus according to claim 3, wherein:

the plurality of terminals includes a phase compensation input terminal for inputting a phase compensation signal to the output circuit of the first power supply circuit from the second main terminal of the external output transistor;

the output circuit of the first power supply circuit includes a push-pull circuit;

the push-pull circuit is connected between the high electrical potential side power supply terminal and the low electric potential side power supply terminal;

the push-pull circuit includes a P channel or PNP type transistor and an N channel or NPN type transistor;

the output node of the output circuit is connected between the P channel or PNP type transistor and the N channel or NPN type transistor;

the phase compensation signal is input to a control terminal of the N channel or NPN type transistor; and the plurality of terminal is arranged in order of the low electric potential side power supply terminal, the phase compensation input terminal, the voltage output terminal, the control signal output terminal, and the high electric potential side power supply terminal.

5. The electric apparatus according to claim 3, further comprising:

a first transistor that is connected between the phase compensation input terminal and the low electric potential side power source input terminal; and a second transistor that is connected between the high electric potential side power supply terminal and the control signal output terminal, wherein the first and second transistors have a limited capability of outputting a current, and the first and second transistors are controlled so as to be in an on state when the first power supply circuit is in a non-operating state.

6. An electric apparatus comprising:

an external output transistor to be coupled with an external unit; and a semiconductor integrated circuit device for controlling the external output transistor, the semiconductor integrate circuit device including (i) a first power supply circuit that includes an output circuit, and that provides a first series regulator in cooperation with the external output transistor, (ii) a second power supply circuit that includes an internal output transistor, and that provides a second series regulator, and (iii) a plurality of terminals, wherein:

the plurality of terminals includes (i) a control signal output terminal for outputting a control signal from an output node of the output circuit of the first power supply circuit to a control terminal of the external output transistor, (ii) a voltage output terminal for outputting a power supply voltage from the internal output transistor of the second power supply circuit, and (iii) a high electric potential side power supply terminal and a low electric potential side power supply terminal for supplying electric power to the first and second power supply circuits, the electric power being used as operating power of the first and second power supply circuits;

at least one of the high and low electric potential side power supply terminals is arranged adjacent to the control signal output terminal and defined as a first terminal;

short-circuiting between the control signal output terminal and the first terminal short-circuit causes the external output transistor to switch into an off state; and at least one of the plurality of terminals, the one which is arranged adjacent to the voltage output terminal, provides a high impedance terminal or an input and output current limit terminal when the second power supply circuit is in an operating state, the voltage output terminal of the plurality of terminal is defined as a first voltage output terminal;

the semiconductor integrated circuit device further includes a third power supply circuit, a configuration of which is substantially identical to that of the second power supply circuit;

the external output transistor is an N channel or NPN type transistor;

the external output transistor includes a first main terminal and a second main terminal, which are provided in a power line leading to an external power source output terminal;

the plurality of terminals further includes a second voltage output terminal;

the first voltage output terminal is connected with the second power supply circuit;

the second voltage output terminal is connected with the third power supply circuit;

the control signal output terminal is connected with the first power supply circuit; and the plurality of terminals is adjacently arranged in order of the low electrical potential side power supply terminal, the control signal output terminal, the first voltage output terminal, and the second voltage output terminal.

7. The electric apparatus according to claim 6, wherein:

the plurality of terminals includes a phase compensation terminal for inputting a phase compensation signal to the output circuit of the first power supply circuit;

the output circuit of the first power supply circuit includes a push-pull circuit;

the push-pull circuit is connected between the high electrical potential side power supply terminal and the low electric potential side power supply terminal;

the push-pull circuit includes a P channel or PNP type transistor and an N channel or NPN type transistor;

the output node of the output circuit is connected between the P channel or PNP type transistor and the N channel or NPN type transistor;

the phase compensation signal is input to a control terminal of the P channel or PNP type transistor in the first power supply circuit; and the plurality of terminal is adjacently arranged in order of the low electric potential side power supply terminal, the control signal output terminal, the first voltage output terminal, the second voltage output terminal, the phase compensation input terminal, and the high electric potential side power supply terminal.

8. The electric apparatus according to claim 7, further comprising:

a first transistor that is connected between the high electric potential side power supply terminal and the phase compensation input terminal; and a second transistor that is connected between the control signal output terminal and the low electric potential side power supply terminal, wherein the first and second transistor have a limited capability of outputting a current, and the first and second transistors are controlled so as to be in an on state when the first power supply circuit is in a non-operating state.

9. An electric apparatus comprising:

an external output transistor to be coupled with an external unit; and a semiconductor integrated circuit device for controlling the external output transistor, the semiconductor integrate circuit device including (i) a first power supply circuit that includes an output circuit, and that provides a first series regulator in cooperation with the external output transistor, (ii) a second power supply circuit that includes an internal output transistor, and that provides a second series regulator, and (iii) a plurality of terminals, wherein:

the plurality of terminals includes (i) a control signal output terminal for outputting a control signal from an output node of the output circuit of the first power supply circuit to a control terminal of the external output transistor, (ii) a voltage output terminal for outputting a power supply voltage from the internal output transistor of the second power supply circuit, and (iii) a high electric potential side power supply terminal and a low electric potential side power supply terminal for supplying electric power to the first and second power supply circuits, the electric power being used as operating power of the first and second power supply circuits;

at least one of the high and low electric potential side power supply terminals is arranged adjacent to the control signal output terminal and defined as a first terminal;

short-circuiting between the control signal output terminal and the first terminal short-circuit causes the external output transistor to switch into an off state; and at least one of the plurality of terminals, the one which is arranged adjacent to the voltage output terminal, provides a high impedance terminal or an input and output current limit terminal when the second power supply circuit is in an operating state, the voltage output terminal of the plurality of terminals is defined as a first voltage output terminal;

the semiconductor integrated circuit device further includes a third power supply circuit, a configuration of which is substantially identical to that of the second power supply circuit;

the external output transistor is a P channel or PNP type transistor;

the external output transistor includes a first main terminal and a second main terminal, which are provided in a power line leading to an external power source output terminal;

the plurality of terminals further includes a second voltage output terminal;

the first voltage output terminal is connected with the second power supply circuit;

the second voltage output terminal is connected with the third power supply circuit;

the control signal output terminal is connected with the first power supply circuit; and the plurality of terminals is adjacently arranged in order of the first voltage output terminal, the second voltage output terminal, the control signal output terminal, and the low electrical potential side power supply terminal.

10. The electric apparatus according to claim 9, wherein:

the plurality of terminals includes a phase compensation terminal for inputting a phase compensation signal to the output circuit of the first power supply circuit;

the push-pull circuit is connected between the high electrical potential side power supply terminal and the low electric potential side power supply terminal;

the push-pull circuit includes a P channel or PNP type transistor and an N channel or NPN type transistor;

the output node of the output circuit is connected between the P channel or PNP type transistor and the N channel or NPN type transistor;

the phase compensation signal is input to a control terminal of the N channel or NPN type transistor in the first power supply circuit; and the plurality of terminals is adjacently arranged in order of the low electric potential side power supply terminal, the phase compensation input terminal, the first voltage output terminal, the second voltage output terminal, the control signal output terminal, and the high electric potential side power supply terminal.

11. The electric apparatus according to claim 10, further comprising:

a first transistor that is connected between the low electric potential side power supply terminal and the phase compensation input terminal; and a second transistor that is connected between the control signal output terminal and the high electric potential side power source input terminal, wherein the first and second transistor have a limited capability of outputting a current, and the first and second transistors are controlled so as to be in an on state when the first power supply circuit is in a non-operating state.

12. The electric apparatus according to claim 6, further comprising:

a selection circuit that is capable of selecting one of the first, second and third power supply circuits to operate based on a selection signal.

* * * * *